US006042521A

United States Patent [19]

De Giorgis

[11] Patent Number: 6,042,521

[45] Date of Patent: Mar. 28, 2000

[54] EXERCISING MEANS

[76] Inventor: Frederick Charles De Giorgis, 39 Peel Place, Wainuiomata, Wellington, New Zealand

[21] Appl. No.: 09/184,534

[22] Filed: Nov. 2, 1998

[30] Foreign Application Priority Data

Nov. 7, 1997 [NZ] New Zealand ..... 329125

[51] Int. Cl.[7] ..... A63B 23/04; A63B 21/02

[52] U.S. Cl. ..... 482/79; 482/146; 482/80

[58] Field of Search ..... 482/79, 80, 146, 482/148, 34; 273/449; 472/111, 112

[56] References Cited

U.S. PATENT DOCUMENTS

| | | | |
|---|---|---|---|
| 2,206,902 | 7/1940 | Kost . | |
| 3,782,721 | 1/1974 | Passera . | |
| 4,739,986 | 4/1988 | Kucharik . | |
| 5,002,272 | 3/1991 | Hofmeister . | |
| 5,062,630 | 11/1991 | Nelson | 482/34 |
| 5,292,296 | 3/1994 | Davignon | 482/146 |
| 5,298,002 | 3/1994 | Lin | 482/53 |
| 5,547,447 | 8/1996 | Liang | 482/34 |
| 5,613,690 | 3/1997 | McShane . | |
| 5,643,164 | 7/1997 | Teff | 482/146 |
| 5,851,166 | 12/1998 | Bernardson | 482/79 |
| 5,897,474 | 4/1999 | Romero | 482/146 |

FOREIGN PATENT DOCUMENTS

| | | |
|---|---|---|
| 238778 | 7/1995 | New Zealand . |
| 1541869 | 3/1979 | United Kingdom . |
| 2270634 | 3/1994 | United Kingdom . |

OTHER PUBLICATIONS

Ken Mac Leay Enterprises (Ski Trainer) Panorama City, California, Sep. 13, 1980.

*Primary Examiner*—Richard J. Apley
*Assistant Examiner*—William LaMarca
*Attorney, Agent, or Firm*—Klauber & Jackson

[57] ABSTRACT

The invention as shown in FIG. 5 is an exercising device to enable a person to exercise his or her feet while seated. More particularly, the exercising device enables a person to simulate a walking action while seated. The exercising device has a base 1 a pivot beam 5, and two footrests 8. Rear parts of the footrests 8 can pivot with respect to the base 1 by way of ball and socket fittings, and forward parts of the footrests 8 can pivot with respect to the pivot beam 5 by way of additional ball and socket fittings. The pivot beam 5 can pivot with respect to the base 1 by way of a further ball and socket fitting. When the exercising device is in use the person can place his or her feet on the footrests and tilt both the feet and footrests from side to side. The person can also cause forward parts of the footrests 8 to move up and down alternately by way of the pivot beam 5 by alternately pushing his or her feet down against the footrests.

6 Claims, 3 Drawing Sheets

EXERCISING MEANS

FIELD OF THE INVENTION

When travelling long distances passengers are usually required to remain seated for significant periods of time. This is particularly the case with international air travel. Remaining in a seated position for long periods of time can result in discomfort due to inactivity of ones limbs and restrictions on the circulation of blood. In some cases this can lead to swelling of the legs and feet, particularly with the elderly. It is therefore an object of at least one form of the present invention to provide exercising means which goes at least some way towards addressing the above problem.

BRIEF SUMMARY OF THE INVENTION

According to one aspect of the invention there is provided exercising mean, comprising base means, a pair of footrests, and elevator means, the exercising means being formed such that when it is in use the footrests can tilt with respect to the base means and also with respect to the elevator means, and wherein a seated person cain place his or her feet on the footrests and tilt the feet from side to side such that the footrests are correspondingly tilted with respect to the base means, and wherein the person can push at least part of one of the feet downwards against one of the footrests such that the elevator means is caused to raise at least a part of the other footrest and at least a part of the other of the feet.

Preferably the exercising means is formed such that when it is in use the footrests can tilt from side to side independently of one another.

Preferably the elevator means comprises a pivot beam wherein the pivot beam can pivot with respect to the base means, and the footrests can pivot with respect to the pivot beam.

Preferably the footrests can engage the base means by way of a ball and socket arrangement.

Preferably the footrests can engage the elevator means by way of a ball and socket arrangement.

Preferably the elevator means can engage the base means by way of a ball and socket arrangement.

Preferably each footrest has ball means adapted to engage a respective socket forming part of the base means.

Preferably the elevator means has central ball means adapted to engage a respective socket forming part of the base means, and wherein the elevator means has a pair of end ball means spaced from one another and each adapted to engage a socket in a respective one of the footrests.

Preferably the footrests each have a raised peripheral edge part suitable for use in preventing the feet from slipping off the footrests when the exercising means is in use.

Some preferred forms of the invention will now be described by way of example, and with reference to the accompanying drawings.

DETAILED DESCRIPTION OF THE INVENTION

Figure 1:
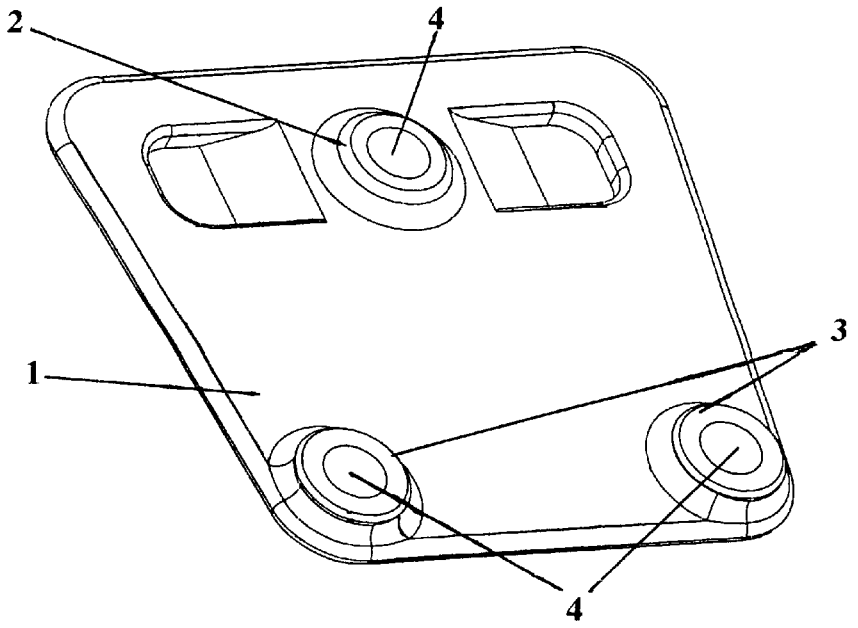
FIG. 1 is a perspective view of a base which forms part of an exercising device.
Figure 2:
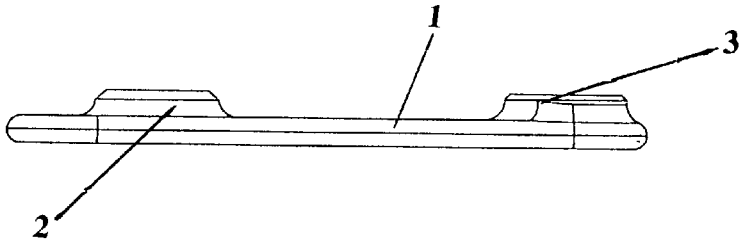
FIG. 2 is a side elevation view of the base.

With reference to FIGS. 1 and 2, the exercising device has a generally flat base 1 with rounded edges. The upper surface of the base 1 has one front raised boss 2 and two rear raised bosses 3. The boss 2 is situated substantially mid-way between opposite sides of the base 1, and the bosses 3 are each placed adjacent a different one of corner parts of the base 1. Each of the bosses 2 and 3 has a hemispherical recess 4.

Figure 3:
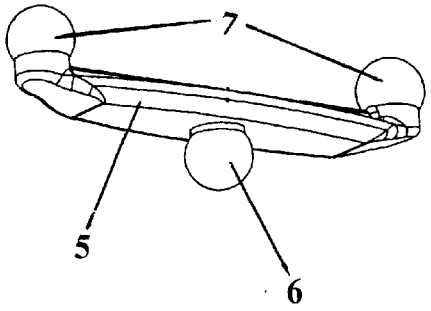
FIG. 3 is a perspective view of a pivot beam which forms part of the exercising device.
Figure 4:
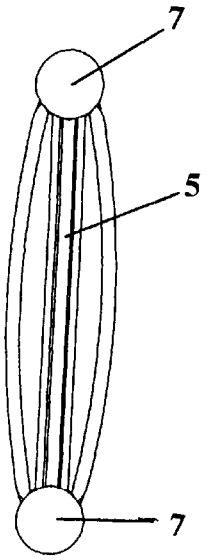
FIG. 4 is a plan view of the pivot beam.

With reference to FIGS. 3 and 4, the exercising device has a pivot beam 5 comprising a central downward facing ball part 6 and two upward facing ball parts 7. The upward facing ball parts 7 are spaced from one another so that they are It opposite ends of the pivot beam 5. As can be seen from FIG. 5, when the base 1 and the pivot beam 5 are assembled with respect to one another the downward facing ball part 6 of the pivot beam is received in the hemispherical recess 4 of the front boss 2 of the base 1. When assembled in this way a cup and ball type fitting is achieved wherein the downward facing ball part 6 can move within the front boss 2.

Figure 5:
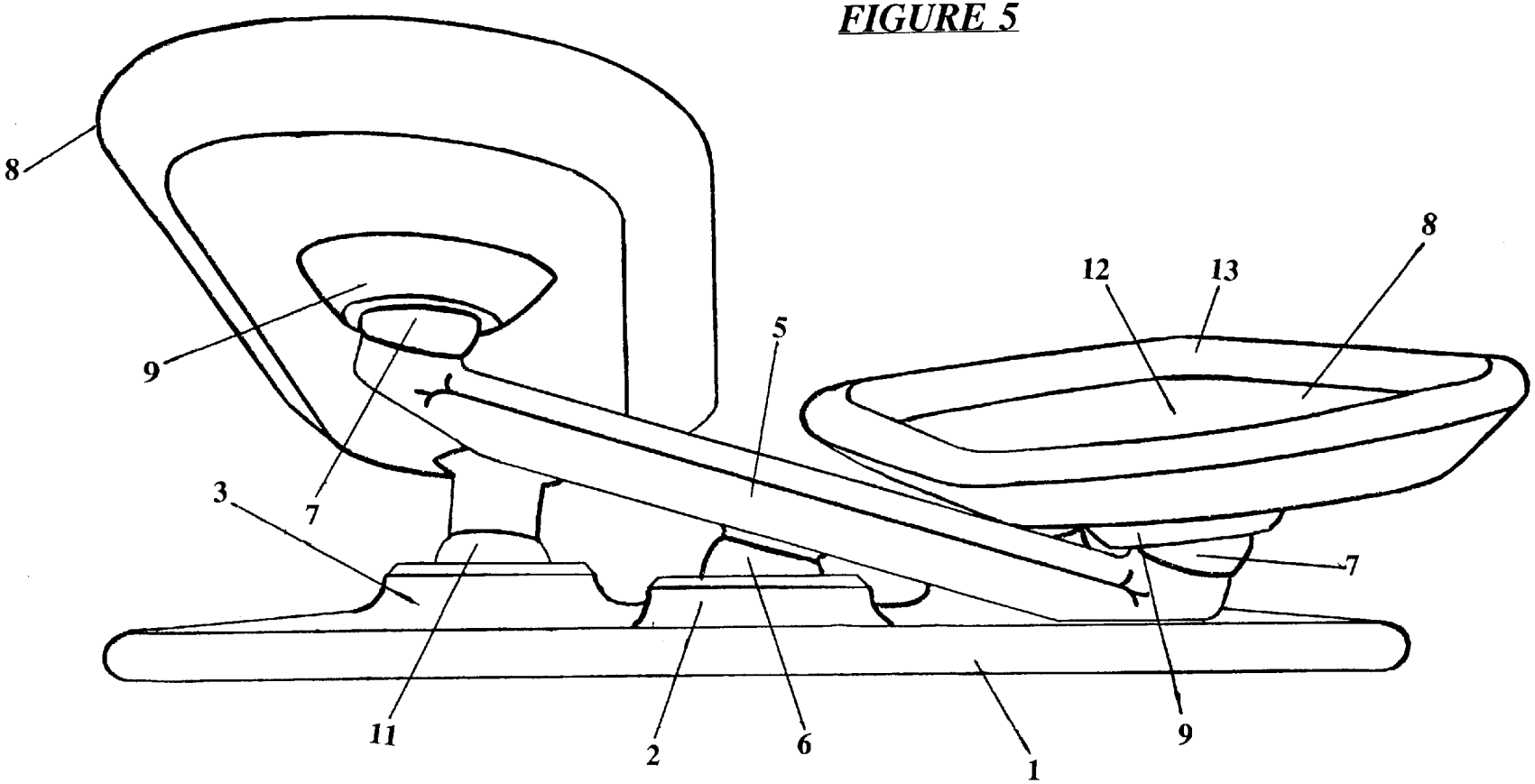
FIG. 5 is a perspective view showing the exercise device when assembled.
Figure 6:
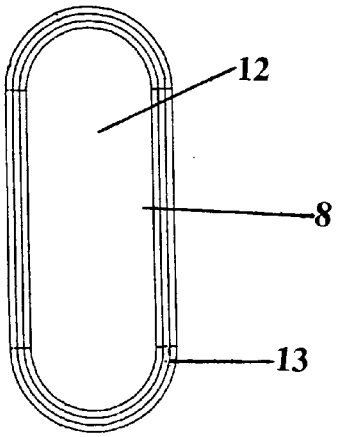
FIG. 6 is a plan view of a foot rest which forms part of the exercising device.
Figure 7:
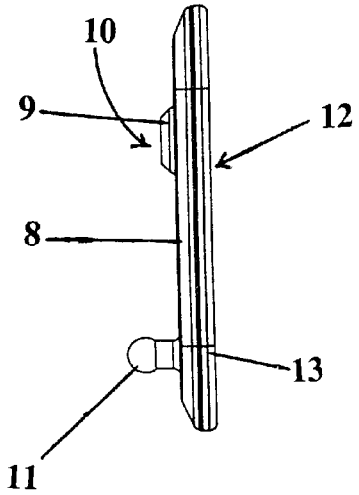
FIG. 7 is a side elevation view of the foot rest.

Referring to FIGS. 5, 6 and 7, the exercising device has two footrests 8. As can be seen from FIG. 7, the front part of each foot rest has a boss 9 comprising a hemispherical recess 10. The rear part of each foot rest has a downward facing ball part 11. More particularly, the bosses 9 and the ball parts 11 extend downwards from the lower surface of their associated footrests 8. Each footrest 8 has an upper surface 12 which is suitable for receiving a foot of a person using the exercising device. A small ledge 13 extends around the periphery of each footrest to prevent the person's feet from slipping off the surfaces 12.

Referring to FIG. 5, when the exercising device is in use the base 1 is laid flat on a floor surface so that it is substantially stationary and its bosses 2 and 3 face upwards. The central downward facing ball part 6 of the pivot beam 5 is placed within the recess of the front boss 2 so that the pivot beam's upward facing ball parts 7 face upwards and lay over and across and the base 1. The boss 9 of each footrest 8 is placed at least partially around a respective one of the upward facing ball parts 7 of the pivot beam 5 to form a cup and ball type fitting. The downward facing ball part 11 of each footrest 8 is placed within the recess 4 of a respective one of the baset's rear bosses 3 to form further cup and ball type fittings.

To operate the exercising device a seated person places his or her feet on the footrests 8. By pushing a forward part of a foot down on a forward part of one of the footrests 8 the pivot beam 5 causes at least the forward part of the other foot and footrest to raise. By pushing down on each foot, one after the other the person can at least substantially simulate a walking action, thereby exercising muscles and enhancing the circulation of blood. It will be appreciated that the simulated walking can be achieved with the person's heels remaining substantially stationary with respect to the base. If desired, the person exercising can roll his or her ankles from side to side while keeping his or her feet firmly planted on the upper surfaces 12 of the footrests 8. Such rolling action of the ankles results in the footrests 8 tilting from side to side without the ball parts 7 and 11 leaving their respective boss recesses.

In at least some forms of the invention the upper surfaces 12 of the foot rests 8 may have a non-slip coating or material applied thereto. Preferably the exercising device is at least substantially formed from a suitable plastics material, although alternative materials could be used if desired. While the invention as described above has cup and ball type fittings, it should be appreciated that alternative pivot arrangements could be used with equal effect. For example, at least some of the bosses may hare recesses which are slot-like or otherwise less than hemispherical. The exercising device may be formed so that it can be readily assembled, and then latter disassembled to fit within a small container for transport and storage. Also, in at least some embodiments of the invention the pivot beam 5 may be substituted by some alternative means for raising and lowering at least part of the footrests.

If desired, the footrests 8 can be used for receiving ones hands rather than the feet. By rolling and/or pushing down on the hands the person's wrists and/or arms, can be exercised.

In some embodiments of the invention the footrests 8 described previously may be replaceable by two disc. The discs may each have an upper surface surrounded by a small ledge. The upper surfaces of the discs can receive the hands of a person using the exercising device, and the ledges of the discs prevent the hands from sliding off the discs. The discs each have a downward extending ball part which can be received in a respective one of the hemispherical recesses of the base's bosses 3. The ball parts of the discs and the bosses 3 together form ball and cup type fittings. When the ball parts of the discs are within the bosses 3 a person can exercise by placing the palms of their hands on the upper surfaces of the discs and rolling or otherwise maneuvering the hands. If desired, the person can place his or her feet, rather than the hands, on the upper surfaces of the discs to exercise his or her ankles, legs and hips, etc. The discs allow for the exercising of the hands, or the feet, independently of one another. If desired, the exercising device can be used with only one of the discs.

While some preferred forms of the invention have been described by way of example. it should be appreciated that modifications and improvements can occur without departing from the scope of the appended claims.

I claim:

1. Exercising means, comprising base means, a pair of footrests, and elevator means, the exercising means being formed such that when it is in use the footrests engage the base means by way of a ball and socket arrangement and the footrests can tilt with respect to the base means and also with respect to the elevator means, and wherein a seated person can place his or her feet on the footrests and tilt the feet from side to side such that the footrests are correspondingly tilted with respect to the base means, and wherein the person can push at least part of one of the feet downwards against one of the footrests such that the elevator means is caused to raise at least a part of the other footrest and at least a part of the other of the feet.

2. Exercising means, comprising base means, a pair of footrests, and elevator means, the exercising means being formed such that when it is in use the footrests engage the elevator means by way of a ball and socket arrangement and the footrests can tilt with respect to the base means and also with respect to the elevator means, and wherein a seated person can place his or her feet on the footrests and tilt the feet from side to side such that the footrests are correspondingly tilted with respect to the base means, and wherein the person can push at least part of one of the feet downwards against one of the footrests such that the elevator means is caused to raise at least a part of the other footrest and at least a part of the other of the feet.

3. Exercising means, comprising base means, a pair of footrests, and elevator means, each footrest having a ball means adapted to engage a respective one of two sockets forming part of the base means, the exercising means being formed such that when it is in use the footrests can tilt with respect to the base means and also with respect to the elevator means, and wherein a seated person can place his or her feet on the footrests and tilt the feet from side to side such that the footrests are correspondingly tilted with respect to the base means, and wherein the person can push at least part of one of the feet downwards against one of the footrests such that the elevator means is caused to raise at least a part of the other footrest and at least a part of the other of the feet.

4. Exercising means comprising base means, a pair of footrests, and elevator means, the elevator means having central ball means adapted to engage a respective socket forming part of the base means, and wherein the elevator means has a pair of end ball means spaced from one another and each adapted to engage a respective socket in a respective one of the footrests, the exercising means being formed such that when it is in use the footrests can tilt with respect to the base means and also with respect to the elevator means, and wherein a seated person can place his or her feet on the footrests and tilt the feet from side to side such that the footrests are correspondingly tilted with respect to the base means, and wherein the person can push at least part of one of the feet downwards against one of the footrests such that the elevator means is caused to raise at least a part of the other footrest and at least a part of the other of the feet.

5. Exercising means according to claim 1, wherein the footrests each have a raised peripheral edge part suitable for use in preventing the feet from slipping off the footrests when the exercising means is in use.

6. Exercising means, comprising a base, a pair of footrests, and a pivot beam, the base having first, second, and third recesses, the footrests each having a recess and a ball part, and the pivot beam having a central ball part and two end ball parts wherein the central ball part is between the end ball parts and the central ball part faces an opposite direction to the end ball parts the exercising means being formed such that when it is in use the ball parts of the footrests form ball and cup fittings each with a respective one of the first and second recesses of the base, the central ball part of the pivot beam forms a ball and cup fitting with the third recess of the base, and the end ball parts of the pivot beam form ball and cup fittings each with a respective one of the recesses of the footrests, and wherein a person can place his or her feet on the footrests and tilt the feet from side to side such that the footrests are correspondingly tilted with respect to the base, and wherein the person can push a forward part of one of the feet downwards against one of the footrests such that the pivot beam is caused to raise a forward part of the other footrest and a forward part of the other of the feet.

* * * * *